US012070077B2

(12) United States Patent
Lee

(10) Patent No.: US 12,070,077 B2
(45) Date of Patent: Aug. 27, 2024

(54) AEROSOL GENERATING DEVICE, METHOD OF OPERATING THE SAME AND CARTRIDGE USED FOR THE SAME

(71) Applicant: KT&G CORPORATION, Daejeon (KR)

(72) Inventor: Won Kyeong Lee, Gyeonggi-do (KR)

(73) Assignee: KT&G CORPORATION, Daejeon (KR)

( * ) Notice: Subject to any disclaimer, the term of this patent is extended or adjusted under 35 U.S.C. 154(b) by 605 days.

(21) Appl. No.: 17/295,306

(22) PCT Filed: Apr. 1, 2021

(86) PCT No.: PCT/KR2021/004080
§ 371 (c)(1),
(2) Date: May 19, 2021

(87) PCT Pub. No.: WO2021/235679
PCT Pub. Date: Nov. 25, 2021

(65) Prior Publication Data

US 2022/0378106 A1 Dec. 1, 2022

(30) Foreign Application Priority Data

May 22, 2020 (KR) ..... 10-2020-0061749

(51) Int. Cl.
*A24F 40/53* (2020.01)
*A24F 40/10* (2020.01)
*A24F 40/42* (2020.01)

(52) U.S. Cl.
CPC ..... *A24F 40/53* (2020.01); *A24F 40/10* (2020.01); *A24F 40/42* (2020.01)

(58) Field of Classification Search
CPC ..... A24F 40/53; A24F 40/10; A24F 40/42
(Continued)

(56) References Cited

U.S. PATENT DOCUMENTS 6,247,775 B1 6/2001 Walker
9,814,263 B2 11/2017 Cochand et al.
(Continued)

FOREIGN PATENT DOCUMENTS

CN 104540406 A 4/2015
CN 108430244 A 8/2018
(Continued)

OTHER PUBLICATIONS

Office Action issued Sep. 13, 2022 in Japanese Application No. 2021-544404.
(Continued)

*Primary Examiner* — Gary F Paumen
(74) *Attorney, Agent, or Firm* — Sughrue Mion, PLLC

(57) ABSTRACT

An aerosol generating device may include a cartridge configured to store an aerosol generating material, and a main body configured to accommodate the cartridge. The cartridge may include a housing that includes an accommodation space that is configured to accommodate the aerosol generating material, and at least one resistance element that passes through the housing in a thickness direction of the housing. The main body may include at least one contact element that is configured to be electrically connected to the at least one resistance element in a case where the cartridge is accommodated in the main body.

14 Claims, 8 Drawing Sheets

(58) Field of Classification Search
USPC ..... 131/328
See application file for complete search history.

(56) References Cited

U.S. PATENT DOCUMENTS

| | | | | |
|---|---|---|---|---|
| 10,531,693 | B1 | 1/2020 | Greenbaum | |
| 10,653,189 | B1 * | 5/2020 | Greenbaum | G07C 9/27 |
| 2015/0219549 | A1 | 8/2015 | Ootsuka et al. | |
| 2017/0231278 | A1 | 8/2017 | Mironov et al. | |
| 2017/0245553 | A1 | 8/2017 | Reevell | |
| 2017/0303587 | A1 | 10/2017 | Johnson et al. | |
| 2018/0055090 | A1 | 3/2018 | Tucker et al. | |
| 2018/0263295 | A1 | 9/2018 | Malamud et al. | |
| 2018/0263296 | A1 | 9/2018 | Sebastian et al. | |
| 2019/0159519 | A1 * | 5/2019 | Bowen | H05B 1/0297 |
| 2020/0000146 | A1 * | 1/2020 | Anderson | H01R 13/6205 |
| 2020/0237013 | A1 | 7/2020 | Yamada et al. | |
| 2020/0260795 | A1 * | 8/2020 | Greenbaum | A24F 40/40 |
| 2020/0260796 | A1 * | 8/2020 | Greenbaum | A24F 1/32 |
| 2020/0260797 | A1 * | 8/2020 | Greenbaum | A24F 40/65 |
| 2020/0345078 | A1 * | 11/2020 | Greenbaum | G07C 9/29 |
| 2020/0352245 | A1 * | 11/2020 | Otiaba | G01F 23/2921 |
| 2021/0007414 | A1 * | 1/2021 | Greenbaum | G07C 9/29 |
| 2021/0084977 | A1 | 3/2021 | Batista et al. | |
| 2021/0084985 | A1 | 3/2021 | Akao et al. | |
| 2021/0112880 | A1 * | 4/2021 | Anderson | H01R 13/6205 |
| 2021/0127751 | A1 * | 5/2021 | Greenbaum | G07C 9/27 |
| 2021/0185765 | A1 | 6/2021 | Reevell | |
| 2021/0204363 | A1 | 7/2021 | Reevell | |
| 2021/0293600 | A1 | 9/2021 | Bessant et al. | |
| 2021/0378298 | A1 * | 12/2021 | Greenbaum | A24F 1/32 |
| 2021/0378299 | A1 * | 12/2021 | Greenbaum | G07C 9/29 |
| 2021/0378300 | A1 * | 12/2021 | Greenbaum | A24F 40/60 |
| 2021/0378301 | A1 * | 12/2021 | Greenbaum | A24F 40/65 |

FOREIGN PATENT DOCUMENTS

| | | | |
|---|---|---|---|
| EP | 2 299 855 | B1 | 3/2016 |
| EP | 3 488 715 | A2 | 5/2019 |
| JP | 2005-156404 | A | 6/2005 |
| JP | 2010-005843 | A | 1/2010 |
| JP | 2011-527415 | A | 10/2011 |
| JP | 2019-509026 | A | 4/2019 |
| JP | 2019-509732 | A | 4/2019 |
| JP | 6651667 | B1 | 2/2020 |
| JP | 2020-508646 | A | 3/2020 |
| KR | 10-2011-0084596 | A | 7/2011 |
| KR | 10-2013-0130759 | A | 12/2013 |
| KR | 10-2015-0038577 | A | 4/2015 |
| KR | 10-1609715 | B1 | 4/2016 |
| KR | 10-1820847 | B1 | 1/2018 |
| KR | 10-2018-0111806 | A | 10/2018 |
| KR | 10-2019-0015224 | A | 2/2019 |
| KR | 10-2019-0060708 | A | 6/2019 |
| WO | 2012/085207 | A1 | 6/2012 |
| WO | 2019/082282 | A1 | 5/2019 |
| WO | 2019/115996 | A1 | 6/2019 |
| WO | 2019/239548 | A | 12/2019 |

OTHER PUBLICATIONS

Extended European Search Report issued May 25, 2022 in European Application No. 21723853.4.

International Search Report dated Aug. 23, 2021 from the International Searching Authority in International Application No. PCT/KR2021/004080.

Office Action issued Jan. 5, 2022 in Korean Application No. 10-2020-0061749.

Notification of Reasons for Refusal dated Feb. 28, 2023 from the Japanese Patent Office in application No. 2021-544404.

* cited by examiner

[Fig. 1]
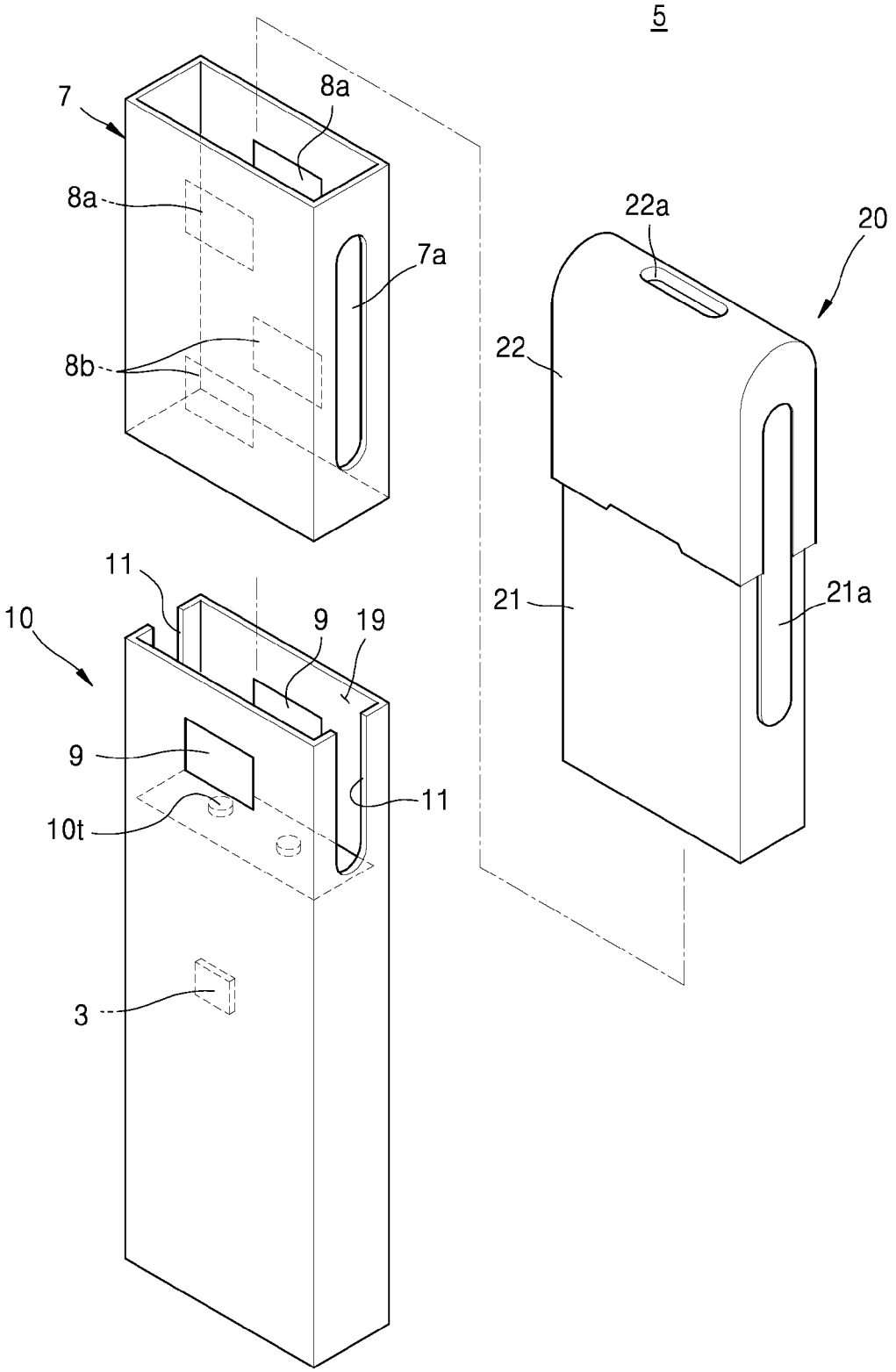

[Fig. 2]
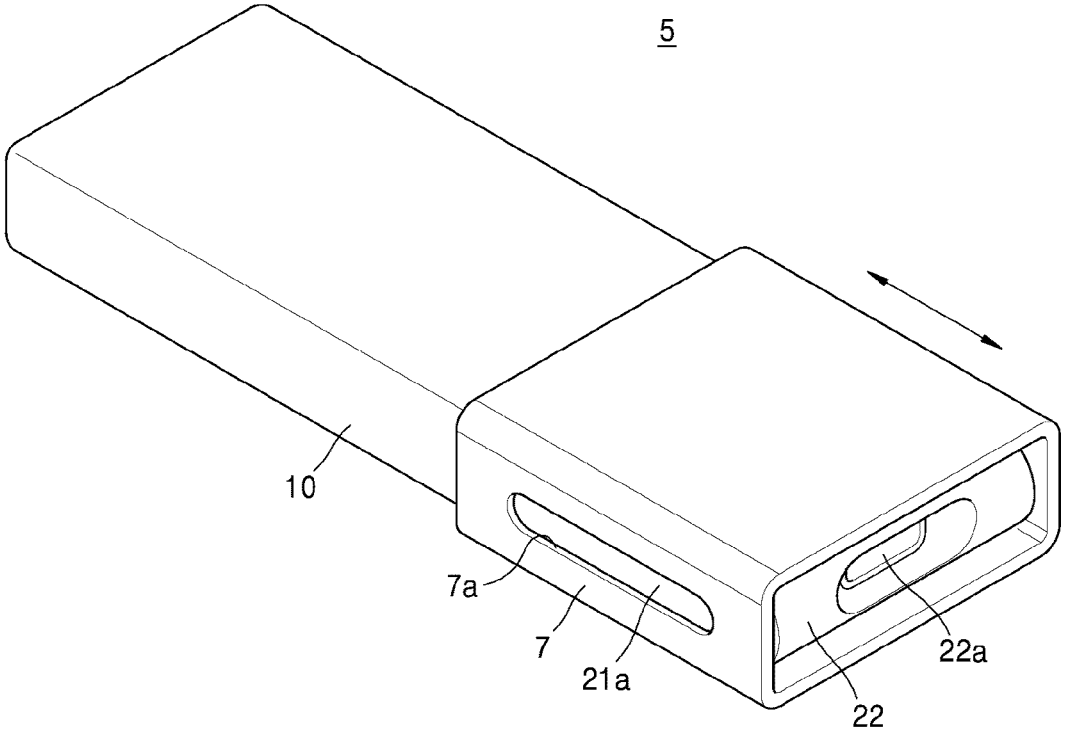
[Fig. 3]
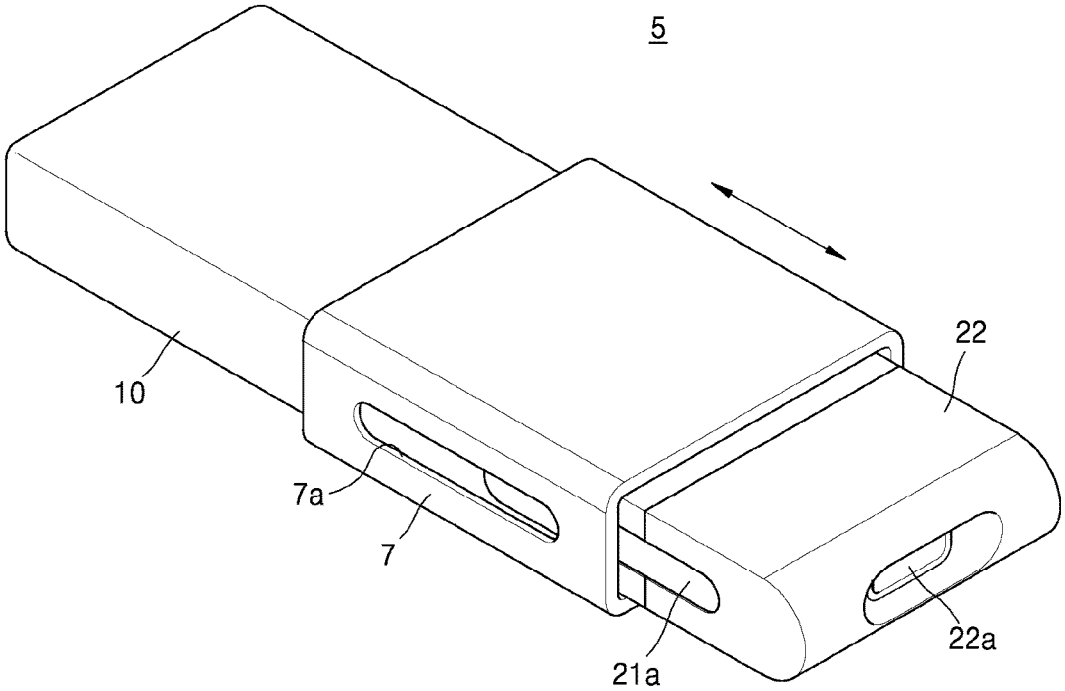

[Fig. 4]
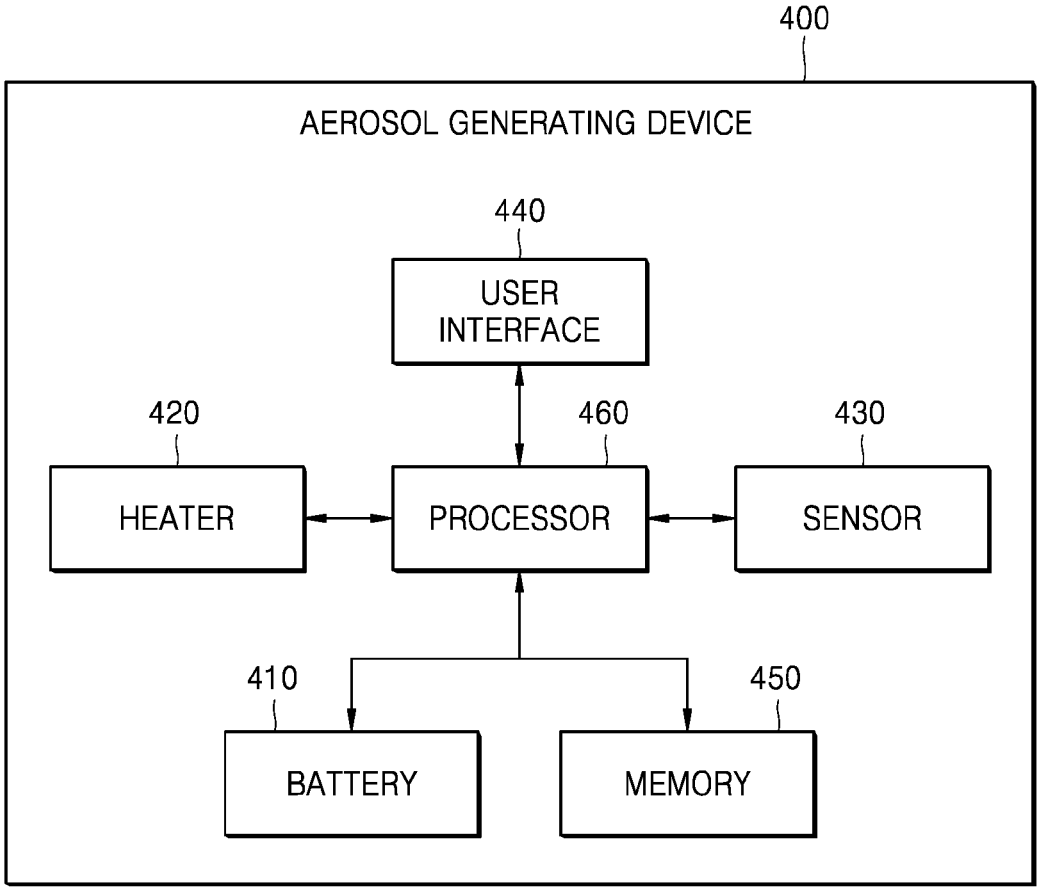
[Fig. 5]
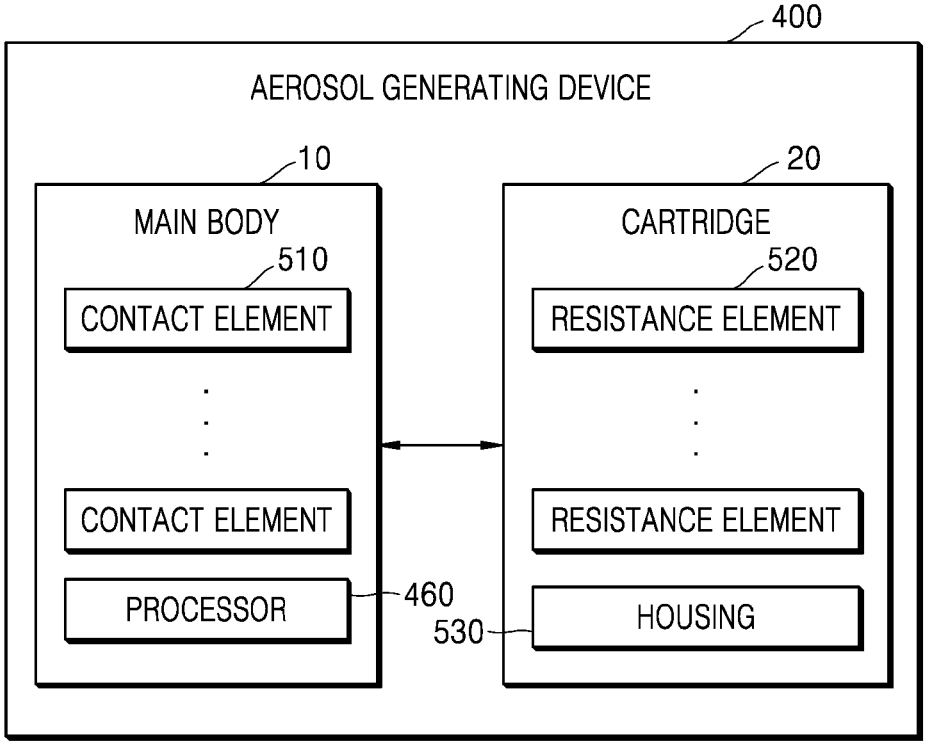

[Fig. 6]
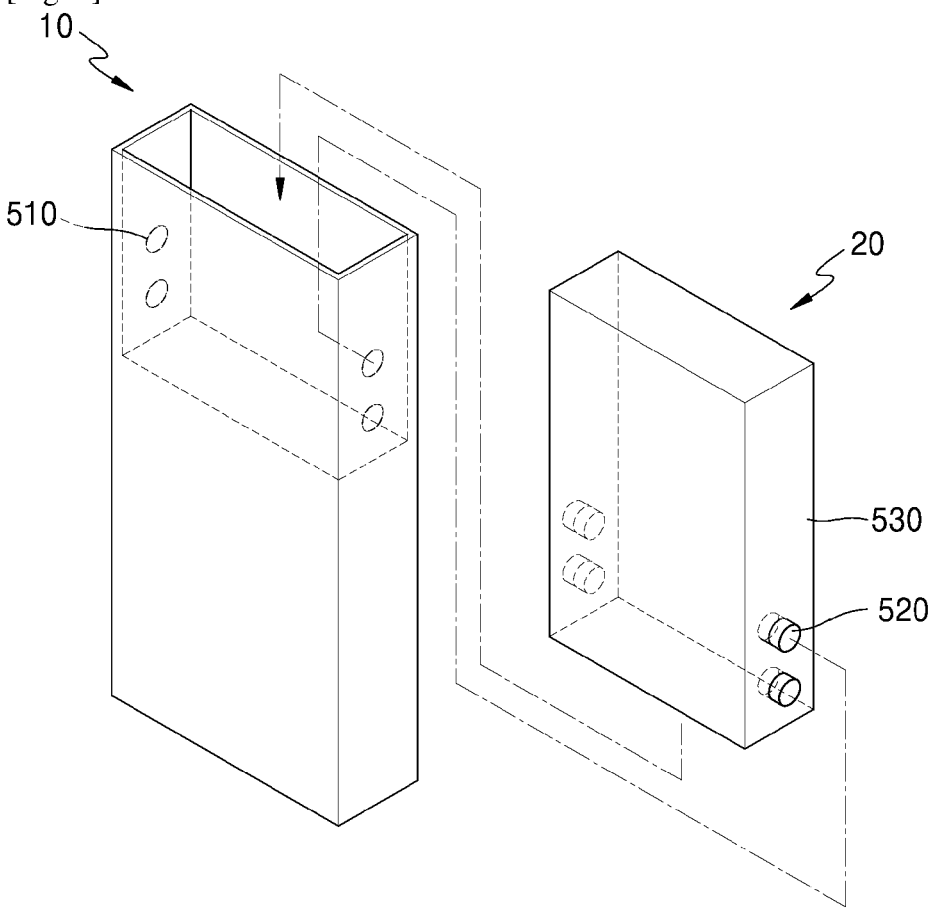
[Fig. 7A]
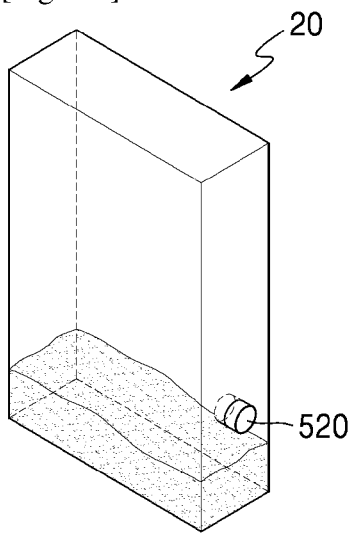

[Fig. 7B]
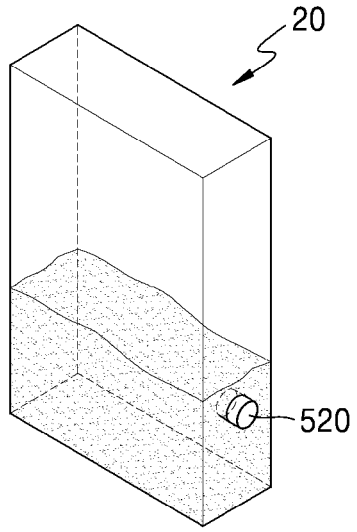
[Fig. 7C]
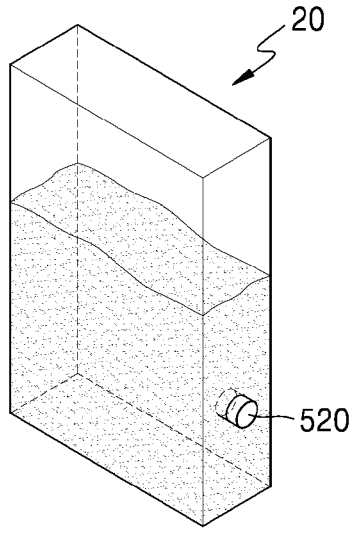
[Fig. 8A]
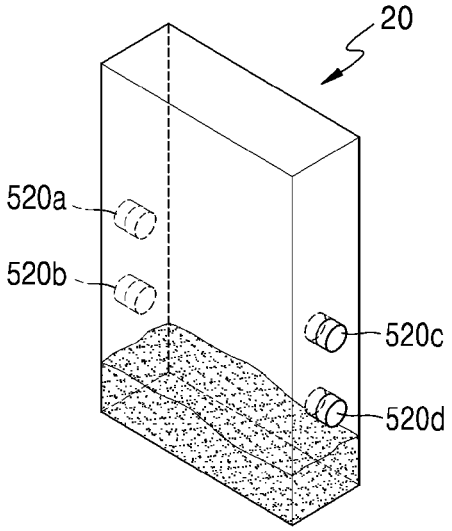

[Fig. 8B]
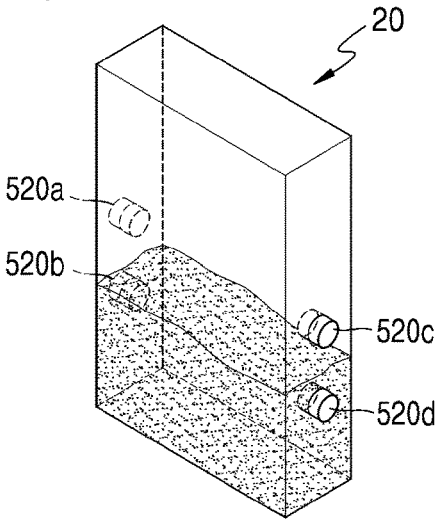
[Fig. 8C]
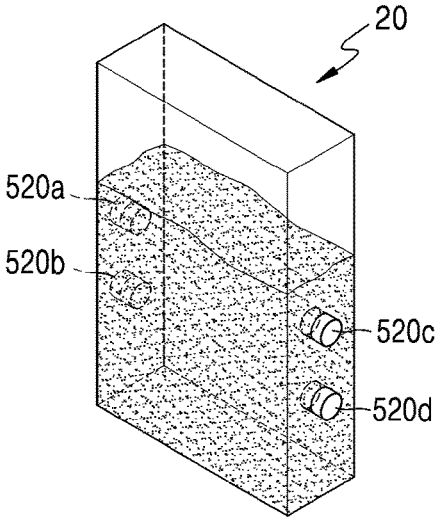
[Fig. 9A]
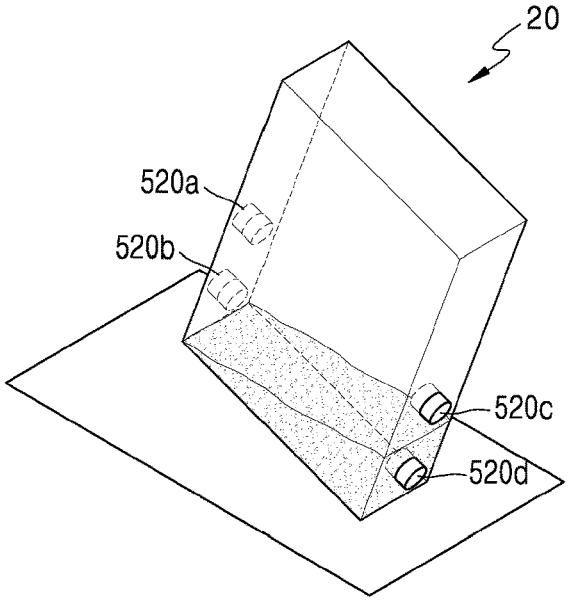

[Fig. 9B]
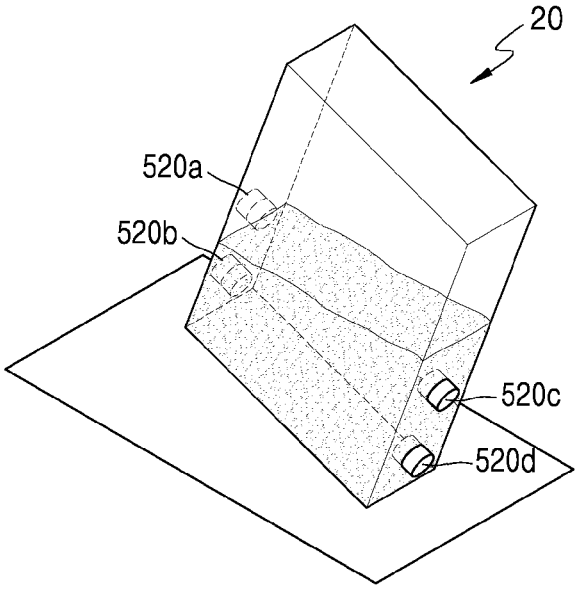
[Fig. 10]
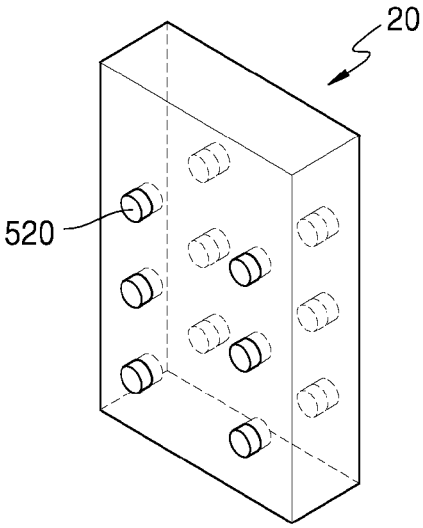

[Fig. 11]
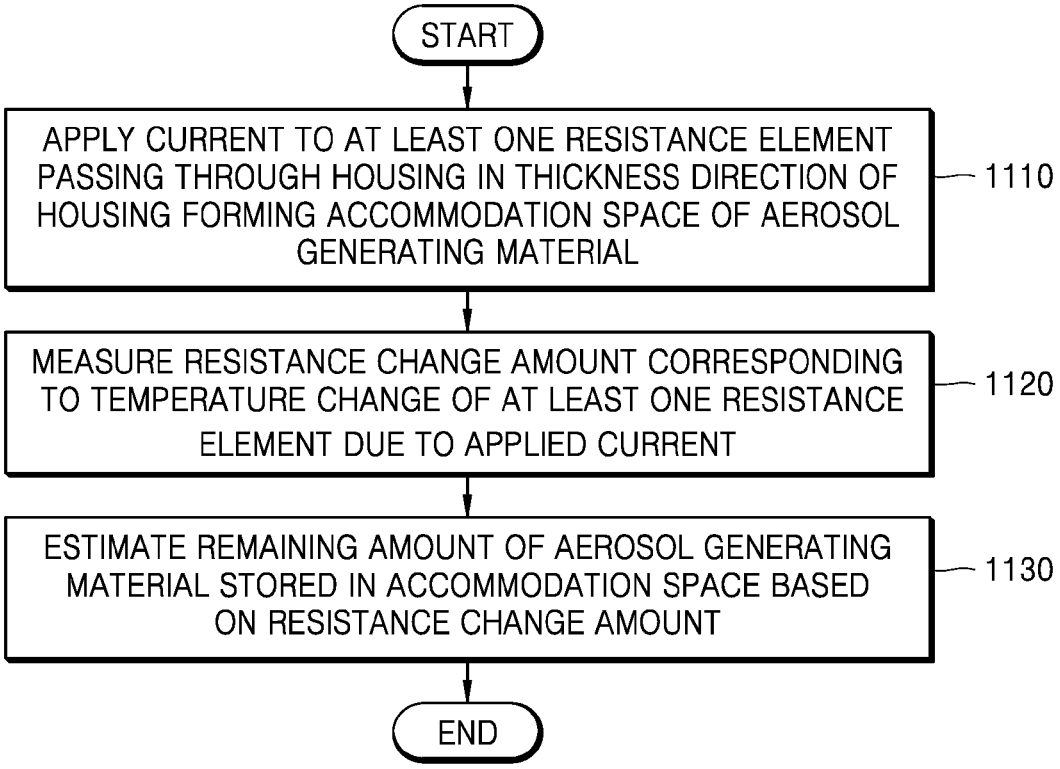
[Fig. 12]
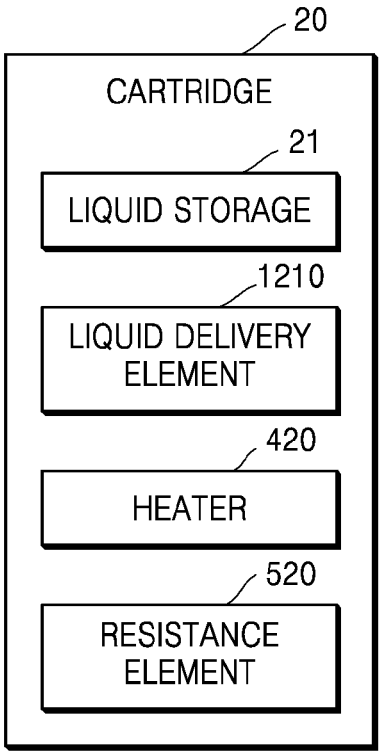

AEROSOL GENERATING DEVICE, METHOD OF OPERATING THE SAME AND CARTRIDGE USED FOR THE SAME

TECHNICAL FIELD

One or more embodiments of the present disclosure relate to an aerosol generating device, a method of operating the same, and a cartridge used for the same.

BACKGROUND ART

Recently, the demand for alternative methods to overcome the disadvantages of traditional aerosol generating articles has increased. For example, there is growing demand for an aerosol generating device which generates aerosol by heating an aerosol generating material in aerosol generating articles, rather than by combusting aerosol generating articles.

In particular, when the user smokes and the remaining amount of an aerosol generating material stored in a cartridge is insufficient, the user's smoking satisfaction may decrease. Thus, technology for checking whether the remaining amount of the aerosol generating material is insufficient, in advance is required.

DISCLOSURE

Technical Problem

One or more embodiments relate to an apparatus for measuring the resistance change amount of a resistance element included in a cartridge and measuring the remaining amount of an aerosol generating material based on the measured resistance change amount of the resistance element. The technical problems to be solved are not limited to the above-described technical problems, and other technical problems may be understood from and solved by the embodiments to be described hereinafter.

Technical Solution

According to an aspect of the present disclosure, an aerosol generating device includes a cartridge in which an aerosol generating material is stored, and a main body in which the cartridge is accommodated, wherein the cartridge includes a housing configured to form an accommodation space of the aerosol generating material and at least one resistance element configured to pass through the housing in a thickness direction of the housing, and the main body includes at least one contact element electrically connected to the at least one resistance element when the cartridge is accommodated in the main body.

Advantageous Effects

An aerosol generating device estimates the remaining amount of aerosol generating material based on the resistance change amount of a resistance element, so that problems caused by insufficient remaining amount of aerosol generating material may be prevented in advance. However, effects of embodiments of the present disclosure are not limited to the above-described effects, and effects that are not mentioned will be clearly understood by those of ordinary skill in the art from the present specification and the accompanying drawings.

DESCRIPTION OF DRAWINGS

FIG. 1 is an exploded perspective view schematically illustrating a coupling relationship between a replaceable cartridge containing an aerosol generating material and an aerosol generating device including the same, according to an embodiment.

FIG. 2 is a perspective view of an example operating state of the aerosol generating device according to the embodiment illustrated in FIG. 1.

FIG. 3 is a perspective view of another example operating state of the aerosol generating device according to the embodiment illustrated in FIG. 1.

FIG. 4 is a block diagram illustrating components of the aerosol generating device according to an embodiment.

FIG. 5 is a block diagram illustrating another example of the configuration of the aerosol generating device.

FIG. 6 illustrates an example of an arrangement of a resistance element and a contact element.

FIG. 7A illustrates an example of a cartridge having one resistance element, in a case where an aerosol generating material is not in contact with the resistance element.

FIG. 7B illustrate an example of the cartridge of FIG. 7A, in a case where the aerosol generating material is in contact with the resistance element.

FIG. 7C illustrate an example of the cartridge of FIG. 7A, in a case where a larger amount of the aerosol generating material than the case illustrated in FIG. 7B, is in contact with the resistance element 520.

FIG. 8A illustrates an example of a cartridge having a plurality of resistance elements, in a case where an aerosol generating material is not in contact with any of the resistance elements.

FIG. 8B illustrates an example of the cartridge of FIG. 8A, in a case where the aerosol generating material is in contact with only two of the resistance elements.

FIG. 8C illustrates an example of the cartridge of FIG. 8A, in a case where the aerosol generating material is in contact with all of the resistance elements.

FIG. 9A illustrates an example in which a cartridge having a plurality of resistance elements is inclined, in a case where only a right lower-end resistance element is in contact with an aerosol generating material.

FIG. 9B illustrate an example of the cartridge of FIG. 9A, in a case where only a left upper-end resistance element is not in contact with the aerosol generating material.

FIG. 10 illustrates another example of a cartridge having a plurality of resistance elements.

FIG. 11 is a flowchart illustrating an example of a method of operating the aerosol generating device, according to an embodiment.

FIG. 12 is a block diagram illustrating an example of the configuration of hardware of the cartridge.

BEST MODE

According to one or more embodiments, an aerosol generating device includes: a cartridge configured to store an aerosol generating material; and a main body configured to accommodate the cartridge, wherein the cartridge comprises: a housing that includes an accommodation space that is configured to accommodate the aerosol generating material; and at least one resistance element that passes through the housing in a thickness direction of the housing, and the main body comprises at least one contact element that is configured to be electrically connected to the at least one resistance element in a case where the cartridge is accommodated in the main body.

According to an embodiment, one side surface of the at least one resistance element is configured to be in contact with the aerosol generating material, and another side surface of the at least one resistance element, opposite to the one side surface, is in contact with the main body.

According to an embodiment, the aerosol generating device further includes a processor configured to estimate a remaining amount of the aerosol generating material based on a resistance change amount of the at least one resistance element due to a current applied to the at least one resistance element through the at least one contact element.

According to an embodiment, the processor is configured to: based on determining that the resistance change amount is less than a first threshold value, determine that the aerosol generating material is in contact with the at least one resistance element, based on determining that the resistance change amount is greater than or equal to the first threshold value, determine that the aerosol generating material is not in contact with the at least one resistance element, and estimate the remaining amount depending on whether the aerosol generating material is determined to be in contact with the at least one resistance element.

According to an embodiment, the processor is configured to: estimate that an amount of the aerosol generating material contacting the at least one resistance element increases based on detecting that the resistance change amount decreases, and estimate that the amount of the aerosol generating material contacting the at least one resistance element decreases based on detecting that the resistance change amount increases.

According to an embodiment, the at least one resistance element is a plurality of resistance elements, and the processor is configured to measure an individual resistance change amount of each of the plurality of resistance elements and estimate the remaining amount of the aerosol generating material based on a difference between the individual resistance change amount of a first resistance element from among the plurality of resistance elements and the individual resistance change amount of a second resistance element from among the plurality of resistance elements.

According to an embodiment, the processor is configured to determine that a level of the aerosol generating material in the cartridge is between the first resistance element and the second resistance element, based on the difference between the individual resistance change amount of the first resistance element and the individual resistance change amount of the second resistance element being greater than or equal to a second threshold value.

According to an embodiment, the processor is configured to estimate the remaining amount of the aerosol generating material based on the resistance change amount corresponding to a temperature change of the at least one resistance element due to the applied current.

According to an embodiment, the processor is configured to apply the current to the at least one resistance element such that a temperature of the at least one resistance element changes to a temperature less than an evaporation point of the aerosol generating material.

According to an embodiment, the processor is configured to apply the current to the at least one resistance element by pulse width modulation (PWM) control, convert a signal corresponding to the resistance change amount into a digital signal through an analog-to-digital converter (ADC), and measure the resistance change amount based on the digital signal.

According to one or more embodiments, a method of operating an aerosol generating device is provided. The method includes: applying a current to at least one resistance element of the aerosol generating device, the at least one resistance element passing through a housing of the aerosol generating device in a thickness direction of the housing, the housing including an accommodation space for accommodating an aerosol generating material; measuring a resistance change amount corresponding to a temperature change of the at least one resistance element due to the applied current; and estimating a remaining amount of the aerosol generating material stored in the accommodation space based on the resistance change amount.

According to an embodiment, the estimating of the remaining amount includes: determining whether the aerosol generating material is in contact with the at least one resistance element based on whether the resistance change amount is less than a first threshold value or greater than or equal to the first threshold value; and estimating the remaining amount depending on whether the aerosol generating material is determined to be in contact with the at least one resistance element.

According to one or more embodiments, a cartridge used for an aerosol generating device is provided. The cartridge includes: a liquid storage comprising a housing that includes an accommodation space, the housing configured to store an aerosol generating material in the accommodation space; a liquid delivery element configured to receive the aerosol generating material from the liquid storage; a heater configured to heat the aerosol generating material delivered to the liquid delivery element; and at least one resistance element that passes through the housing in a thickness direction of the housing, wherein one side surface of the at least one resistance element is configured to be in contact with the aerosol generating material, and another side surface of the at least one resistance element, opposite to the one side surface, is configured to be in contact with a main body of the aerosol generating device, such that the at least one resistance element is electrically connected to at least one contact element of the main body.

According to an embodiment, the at least one resistance element is a plurality of resistance elements.

According to an embodiment, the plurality of resistance elements comprises a first resistance element and a second resistance element, the second resistance element located at a different height position in the housing than the first resistance element.

Mode for Invention

Hereinafter, non-limiting example embodiments of the present disclosure will now be described more fully with reference to the accompanying drawings, such that one of ordinary skill in the art may easily work the present disclosure. Embodiments of the disclosure may, however, be embodied in many different forms and should not be construed as being limited to the embodiments set forth herein.

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used to describe the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

As used herein, terms including an ordinal number such as "first" or "second" may be used to describe various components, but the components should not be limited by the terms. The terms are used only for the purpose of distinguishing one component from other components.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element is referred to as being "over," "above," "on," "below," "under," "beneath," "connected to" or "coupled to" another element, it can be directly over, above, on, below, under, beneath, connected or coupled to the other element or intervening elements may be present. In contrast, when an element is referred to as being "directly over," "directly above," "directly on," "directly below," "directly under," "directly beneath," "directly connected to" or "directly coupled to" another element, there are no intervening elements present.

Hereinafter, embodiments of the present disclosure will be described in detail with reference to the drawings.

FIG. 1 is an exploded perspective view schematically illustrating a coupling relationship between a replaceable cartridge containing an aerosol generating material and an aerosol generating device including the same, according to an embodiment.

An aerosol generating device 5 according to the embodiment illustrated in FIG. 1 includes a cartridge 20, containing the aerosol generating material, and a main body 10 supporting the cartridge 20.

The cartridge 20 may be coupled to the main body 10 when the aerosol generating material is accommodated therein. A portion of the cartridge 20 is inserted into an accommodation space 19 of the main body 10 so that the cartridge 20 may be mounted on the main body 10.

The cartridge 20 may contain an aerosol generating material in any one of, for example, a liquid state, a solid state, a gaseous state, and a gel state. The aerosol generating material may include a liquid composition. For example, the liquid composition may be a liquid including a tobacco-containing material having a volatile tobacco flavor component, or a liquid including a non-tobacco material.

For example, the liquid composition may include one component of water, solvents, ethanol, plant extracts, spices, flavorings, and vitamin mixtures, or a mixture of these components. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. In addition, the liquid composition may include an aerosol forming agent such as glycerin and propylene glycol.

For example, the liquid composition may include any weight ratio of a glycerin and propylene glycol solution to which nicotine salts are added. The liquid composition may include two or more types of nicotine salts. Nicotine salts may be formed by adding suitable acids, including organic or inorganic acids, to nicotine. Nicotine may be a naturally generated nicotine or synthetic nicotine and may have any suitable weight concentration relative to the total solution weight of the liquid composition.

Acid for the formation of the nicotine salts may be appropriately selected considering the rate of nicotine absorption in the blood, the operating temperature of the aerosol generating device 5, the flavor or savor, the solubility, or the like. For example, the acid for the formation of nicotine salts may be a single acid selected from the group consisting of benzoic acid, lactic acid, salicylic acid, lauric acid, sorbic acid, levulinic acid, pyruvic acid, formic acid, acetic acid, propionic acid, butyric acid, valeric acid, caproic acid, caprylic acid, capric acid, citric acid, myristic acid, palmitic acid, stearic acid, oleic acid, linoleic acid, linolenic acid, phenylacetic acid, tartaric acid, succinic acid, fumaric acid, gluconic acid, saccharic acid, malonic acid or malic acid, or a mixture of two or more acids selected from the group, but is not limited thereto.

The cartridge 20 is operated by an electrical signal or a wireless signal transmitted from the main body 10 to perform a function of generating aerosol by converting the phase of the aerosol generating material inside the cartridge 20 to a gaseous phase. The aerosol may refer to a gas in which vaporized particles generated from an aerosol generating material are mixed with air.

For example, the cartridge 20 may convert the phase of the aerosol generating material by receiving an electrical signal from the main body 10 and heating the aerosol generating material, or by using an ultrasonic vibration method, or by using an induction heating method. As another example, when the cartridge 20 includes its own power source, the cartridge 20 may generate aerosol by being operated by an electric control signal or a wireless signal transmitted from the main body 10 to the cartridge 20.

The cartridge 20 may include a liquid storage 21 accommodating the aerosol generating material therein, and an atomizer performing a function of converting the aerosol generating material of the liquid storage 21 to aerosol.

When the liquid storage 21 "accommodates the aerosol generating material" therein, it means that the liquid storage 21 functions as a container simply holding an aerosol generating material and that the liquid storage 21 includes therein an element impregnated with (or containing) an aerosol generating material, such as a sponge, cotton, fabric, or porous ceramic structure.

The atomizer may include, for example, a liquid delivery element (wick) for absorbing the aerosol generating material and maintaining the same in an optimal state for conversion to aerosol, and a heater heating the liquid delivery element to generate aerosol.

The liquid delivery element may include at least one of, for example, a cotton fiber, a ceramic fiber, a glass fiber, and porous ceramic.

The heater may include a metallic material such as copper, nickel, tungsten, or the like to heat the aerosol generating material delivered to the liquid delivery element by generating heat using electrical resistance. The heater may be implemented by, for example, a metal wire, a metal plate, a ceramic heating element, or the like, and may be implemented by a conductive filament, wound on the liquid delivery element, or arranged adjacent to the liquid delivery element, by using a material such as a nichrome wire.

In addition, the atomizer may be implemented by a heating element in the form of a mesh or plate, which performs both the functions of absorbing the aerosol generating material and maintaining the same in an optimal state for conversion to aerosol without using a separate liquid delivery element, and the function of generating aerosol by heating the aerosol generating material.

At least a portion of the liquid storage 21 of the cartridge 20 may include a transparent material so that the aerosol generating material accommodated in the cartridge 20 may be visually identified from the outside. The liquid storage 21 includes a protruding window 21*a* protruding from the liquid storage 21, so that the liquid storage 21 may be inserted into a groove 11 of the main body 10 when coupled to the main body 10. A mouthpiece 22 and the liquid storage 21 may be entirely formed of transparent plastic or glass, or only the protruding window 21*a* corresponding to a portion of the liquid storage 21 may be formed of a transparent material.

The main body 10 includes a connection terminal 10*t* arranged inside the accommodation space 19. When the liquid storage 21 of the cartridge 20 is inserted into the accommodation space 19 of the main body 10, the main body 10 may provide power to the cartridge 20 through the connection terminal 10*t* or supply a signal related to an operation of the cartridge 20 to the cartridge 20 through the connection terminal 10*t*.

The mouthpiece 22 is coupled to one end of the liquid storage 21 of the cartridge 20. The mouthpiece 22 is a portion of the aerosol generating device 5, which is to be inserted into a user's mouth. The mouthpiece 22 includes a discharge hole 22*a* for discharging aerosol generated from the aerosol generating material inside the liquid storage 21 to the outside.

A slider 7 is coupled to the main body 10 to move with respect to the main body 10. The slider 7 covers at least a portion of the mouthpiece 22 of the cartridge 20 coupled to the main body 10 or exposes at least a portion of the mouthpiece 22 to the outside by moving with respect to the main body 10. The slider 7 includes an elongated hole 7*a* exposing at least a portion of the protruding window 21*a* of the cartridge 20 to the outside.

The slider 7 has a container shape with a hollow space therein and both ends open. The structure of the slider 7 is not limited to the container shape as shown in the drawing, and the slider 7 may have a bent plate structure having a clip-shaped cross-section, which is movable with respect to the main body 10 while being coupled to an edge of the main body 10, or a structure having a curved semi-cylindrical shape and a curved arc-shaped cross-section.

The slider 7 includes a magnetic body for maintaining the position of the slider 7 with respect to the main body 10 and the cartridge 20. The magnetic body may include a permanent magnet or a material such as iron, nickel, cobalt, or an alloy thereof.

The magnetic body includes two first magnetic bodies 8*a* facing each other with an inner space of the slider 7 therebetween, and two second magnetic bodies 8*b* facing each other with the inner space of the slider 7 therebetween. The first magnetic bodies 8*a* and the second magnetic bodies 8*b* are arranged to be spaced apart from each other along a longitudinal direction of the main body 10, which is a moving direction of the slider 7, that is, the direction in which the main body 10 extends.

The main body 10 includes at least one fixed magnetic body 9 arranged on a path along which the first magnetic bodies 8*a* and the second magnetic bodies 8*b* of the slider 7 move while the slider 7 moves with respect to the main body 10. For example, two fixed magnetic bodies 9 of the main body 10 may be mounted to face each other with the accommodation space 19 therebetween.

Depending on the position of the slider 7, the slider 7 may be stably maintained in a position where an end of the mouthpiece 22 is covered or exposed by a magnetic force acting between at least one of the fixed magnetic bodies 9 and at least one of the first magnetic bodies 8*a* or between at least one of the fixed magnetic bodies 9 and at least one of the second magnetic bodies 8*b*.

The main body 10 includes a position change detecting sensor 3 arranged on the path along which one of the first magnetic bodies 8*a* and one of the second magnetic bodies 8*b* of the slider 7 move while the slider 7 moves with respect to the main body 10. The position change detecting sensor 3 may include, for example, a Hall IC using the Hall effect that detects a change in a magnetic field and generates a signal.

In the aerosol generating device 5 according to the above-described embodiments, the main body 10, the cartridge 20, and the slider 7 have approximately rectangular cross-sectional shapes in a direction transverse to the longitudinal direction, but in the embodiments, the shape of the aerosol generating device 5 is not limited. The aerosol generating device 5 may have, for example, a cross-sectional shape of a circle, an ellipse, a square, or various polygonal shapes. In addition, the aerosol generating device 5 is not necessarily limited to a structure that extends linearly when extending in the longitudinal direction, and may extend a long way while being curved in a streamlined shape or bent at a preset angle in a specific area to be easily held by the user.

FIG. 2 is a perspective view of an example operating state of the aerosol generating device according to the embodiment illustrated in FIG. 1.

In FIG. 2, the operating state is shown in which the slider 7 is moved to a position where the end of the mouthpiece 22 of the cartridge coupled to the main body 10 is covered. In a state where the slider 7 is moved to the position where the end of the mouthpiece 22 is covered, the mouthpiece 22 may be safely protected from external impurities and kept clean.

The user may check the remaining amount of aerosol generating material contained in the cartridge by visually checking the protruding window 21*a* of the cartridge through the elongated hole 7*a* of the slider 7. The user may move the slider 7 in the longitudinal direction of the main body 10 to use the aerosol generating device 5.

FIG. 3 is a perspective view of another example operating state of the aerosol generating device according to the embodiment illustrated in FIG. 1.

In FIG. 3, the operating state is shown in which the slider 7 is moved to a position where the end of the mouthpiece 22 of the cartridge coupled to the main body 10 is exposed to the outside. In a state where the slider 7 is moved to the position where the end of the mouthpiece 22 is exposed to the outside, the user may insert the mouthpiece 22 into his or her mouth and absorb aerosol discharged through the discharge hole 22*a* of the mouthpiece 22.

FIG. 4 is a block diagram illustrating components of the aerosol generating device according to an embodiment. The aerosol generating device 400 illustrated in FIG. 4 may correspond to the aerosol generating device 5 described above with reference to FIG. 1.

Referring to FIG. 4, the aerosol generating device 400 may include a battery 410, a heater 420, a sensor 430, a user interface 440, a memory 450, and a processor 460. However, the internal structure of the aerosol generating device 400 is not limited to the structures illustrated in FIG. 4. According to the design of the aerosol generating device 400, it will be understood by one of ordinary skill in the art that some of the hardware components shown in FIG. 4 may be omitted or new components may be added.

In an embodiment, the aerosol generating device 400 may consist of only a main body, in which case hardware components included in the aerosol generating device 400 are located in the main body. In another embodiment, the aerosol generating device 400 may comprise or consist of a main body and a cartridge, in which case hardware components included in the aerosol generating device 400 are located separately in the main body and the cartridge. Alternatively, at least some of hardware components included in the aerosol generating device 400 may be located respectively in the main body and the cartridge.

Hereinafter, an operation of each of the components will be described without being limited to a particular location in the aerosol generating device 400.

The battery 410 supplies power to be used for the aerosol generating device 400 to operate. In other words, the battery 410 may supply power such that the heater 420 may be heated. In addition, the battery 410 may supply power required for operation of other hardware components included in the aerosol generating device 400, that is, the sensor 430, the user interface 440, the memory 450, and the processor 460. The battery 410 may be a rechargeable battery or a disposable battery. For example, the battery 410 may be a lithium polymer (LiPoly) battery, but is not limited thereto.

The heater 420 receives power from the battery 410 under the control of the processor 460. The heater 420 may receive power from the battery 410 and heat a cigarette inserted into the aerosol generating device 400, or heat the cartridge mounted on the aerosol generating device 400.

The heater 420 may be located in the main body of the aerosol generating device 400. Alternatively, when the aerosol generating device 400 comprises or consists of the main body and the cartridge, the heater 420 may be located in the cartridge. When the heater 420 is located in the cartridge, the heater 420 may receive power from the battery 410 located in at least one of the main body and the cartridge.

The heater 420 may be formed of any suitable electrically resistive material. For example, the suitable electrically resistive material may be a metal or a metal alloy including titanium, zirconium, tantalum, platinum, nickel, cobalt, chromium, hafnium, niobium, molybdenum, tungsten, tin, gallium, manganese, iron, copper, stainless steel, or nichrome, but is not limited thereto. In addition, the heater 420 may be implemented by a metal wire, a metal plate on which an electrically conductive track is arranged, or a ceramic heating element, but is not limited thereto.

In an embodiment, the heater 420 may be a component included in the cartridge. The cartridge may include the heater 420, the liquid delivery element, and the liquid storage. The aerosol generating material accommodated in the liquid storage may be moved to the liquid delivery element, and the heater 420 may heat the aerosol generating material absorbed by the liquid delivery element, thereby generating aerosol. For example, the heater 420 may include a material such as nickel chromium and may be wound around or arranged adjacent to the liquid delivery element.

In another embodiment, the heater 420 may heat the cigarette inserted into the accommodation space of the aerosol generating device 400. As the cigarette is accommodated in the accommodation space of the aerosol generating device 400, the heater 420 may be located inside and/or outside the cigarette. Accordingly, the heater 420 may generate aerosol by heating the aerosol generating material in the cigarette.

Meanwhile, the heater 420 may include an induction heater. The heater 420 may include an electrically conductive coil for heating an aerosol generating article in an induction heating method, and the aerosol generating article or the cartridge may include a susceptor which may be heated by the induction heater.

The aerosol generating device 400 may include at least one sensor 430. A result sensed by the at least one sensor 430 is transmitted to the processor 460, and the processor 460 may control the aerosol generating device 400 to perform various functions such as controlling the operation of the heater, restricting smoking, determining whether a cigarette (or a cartridge) is inserted, and displaying a notification. For example, the at least one sensor 430 may include a puff detecting sensor.

The puff detecting sensor may detect a user's puff based on any one of a temperature change, a flow change, a voltage change, and a pressure change. For example, the processor 460 may control the generation of aerosol based on the result sensed by the puff detecting sensor.

In addition, the at least one sensor 430 may include a temperature detecting sensor. The temperature detecting sensor may detect the temperature at which the heater 420 (or an aerosol generating material) is heated. The aerosol generating device 400 may include a separate temperature detecting sensor for sensing a temperature of the heater 420, or the heater 420 itself may serve as a temperature detecting sensor instead of including a separate temperature detecting sensor. Alternatively, a separate temperature detecting sensor may be further included in the aerosol generating device 400 while the heater 420 serves as a temperature detecting sensor.

In addition, the at least one sensor 430 may include a position change detecting sensor. The position change detecting sensor may detect a change in a position of the slider coupled to the main body to move with respect to the main body.

The user interface 440 may provide the user with information about the state of the aerosol generating device 400. The user interface 440 may include various interfacing devices, such as a display or a light emitter for outputting visual information, a motor for outputting haptic information, a speaker for outputting sound information, input/output (I/O) interfacing devices (e.g., a button or a touch screen) for receiving information input from the user or outputting information to the user, terminals for performing data communication or receiving charging power, and communication interfacing modules for performing wireless communication (e.g., Wi-Fi, Wi-Fi direct, Bluetooth, near-field communication (NFC), etc.) with external devices.

According to embodiments, the aerosol generating device 400 may be implemented by selecting only some of the above-described examples of the various described interfacing devices.

The memory 450, as a hardware component configured to store various pieces of data processed in the aerosol generating device 400, may store data processed or to be processed by the processor 460. The memory 450 may include various types of memories, such as random access memory (RAM) (e.g., dynamic random access memory (DRAM) and static random access memory (SRAM), etc.), read-only memory (ROM), electrically erasable programmable read-only memory (EEPROM), etc.

The memory 450 may store an operation time of the aerosol generating device 400, the maximum number of puffs, the current number of puffs, at least one temperature profile, data on a user's smoking pattern, etc.

The processor 460 may generally control operations of the aerosol generating device 400. The processor 460 can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware. The memory may store computer code that, when executed by the processor 406, is configured to cause the processor 460 to perform its functions as described in the present disclosure.

The processor 460 analyzes a result of the sensing by at least one sensor 430, and controls the processes that are to be performed subsequently.

The processor 460 may control power supplied to the heater 420 so that the operation of the heater 420 is started or terminated, based on the result of the sensing by the at least one sensor 430. In addition, based on the result of the sensing by the at least one sensor 430, the processor 460 may control the amount of power supplied to the heater 420 and the time at which the power is supplied, so that the heater 420 is heated to a predetermined temperature or maintained at an appropriate temperature.

In an embodiment, the processor 460 may set a mode of the heater 420 to a pre-heating mode to start the operation of the heater 420 after receiving a user input to the aerosol generating device 400. In addition, the processor 460 may switch the mode of the heater 420 from the pre-heating mode to an operation mode after detecting a user's puff by using the puff detecting sensor. In addition, the processor 460 may stop supplying power to the heater 420 when the number of puffs reaches a preset number after counting the number of puffs by using the puff detecting sensor.

The processor 460 may control the user interface 440 based on the result of the sensing by the at least one sensor 430. For example, when the number of puffs reaches the preset number after counting the number of puffs by using the puff detecting sensor, the processor 460 may notify the user by using at least one of a light emitter, a motor, or a speaker that operation of the aerosol generating device 400 will soon be terminated.

Although not illustrated in FIG. 4, the aerosol generating device 400 may form an aerosol generating system together with an additional cradle. For example, the cradle may be used to charge the battery 410 of the aerosol generating device 400. For example, while the aerosol generating device 400 is accommodated in an accommodation space of the cradle, the aerosol generating device 400 may receive power from a battery of the cradle such that the battery 410 of the aerosol generating device 400 may be charged.

FIG. 5 is a block diagram illustrating another example of the configuration of the aerosol generating device.

Referring to FIG. 5, the aerosol generating device 400 may include a main body 10 and a cartridge 20. The main body 10 may include at least one contact element 510 and a processor 460. The cartridge 20 may include at least one resistance element 520 and a housing 530. The main body 10, the cartridge 20, and the processor 460 of FIG. 5 may correspond to the main body 10, the cartridge 20, and the processor 460 of FIGS. 1 through 4, respectively.

In the aerosol generating device 400 shown in FIG. 5, some components related to the present embodiment are shown. It will be understood by those skilled in the art that general-purpose components other than the components shown in FIG. 5 may be further included in the aerosol generating device 400.

The cartridge 20 may store an aerosol generating material and may be stored in the main body 10. The cartridge 20 may include the housing 530 that forms an accommodation space of the aerosol generating material. The housing 530 may form the exterior of the cartridge 20. The aerosol generating material may be accommodated in the accommodation space formed in the housing 530.

The cartridge 20 may include at least one resistance element 520 used to estimate a remaining amount of the aerosol generating material stored in the cartridge 20. The resistance element 520 may pass through the housing 530 in the thickness direction of the housing 530. For example, one side surface of the resistance element 520 may be in contact with the aerosol generating material stored in the cartridge 20, and another side surface opposite to the one side surface may be in contact with the main body 10 for accommodating the cartridge 20.

The resistance element 520 may be electrically connected to the main body 10 by being in contact with the main body 10, and a current may be applied to the resistance element 520 from the main body 10. The temperature of the resistance element 520 may change by an applied current, and the resistance of the resistance element 520 may be changed as the temperature of the resistance element 520 changes. The resistance element 520 may include a material having a large amount of resistance change relative to temperature change. The amount of resistance change relative to the temperature change of the material may be indicated by the temperature coefficient of resistance (TCR). The resistance element 520 may include, for example, a material having a large TCR (e.g., iron, nickel, copper, aluminum, tungsten, tin, etc.). However, the material for forming the resistance element 520 is not limited to the above-described materials. Depending on the constituent material of the resistance element 520, a resistance change amount relative to the current applied to the resistance element 520 may be different.

When the cartridge 20 is inserted into the main body 10, the main body 10 may include at least one contact element 510 electrically connected to the resistance element 520. The contact element 510 that is a component for transmitting the current applied from the main body 10 to the resistance element 520 may include a conductor material. However, because a change in the temperature of the contact element 510 may affect the resistance element 520, a material for forming the contact element 510 may include a material having a small temperature change relative to the applied current.

In addition, the contact element 510 may be a component for transmitting a signal corresponding to the resistance change amount of the contact element 520. The arrangement of the resistance element 520 and the contact element 510 will be described in detail with reference to FIG. 6.

The processor 460 may apply a current to the resistance element 520 through the contact element 510 so as to estimate the remaining amount of the aerosol generating material. The processor 460 may estimate the remaining amount of the aerosol generating material stored in the cartridge 20 based on the resistance change amount of the resistance element 520 due to the current applied to the resistance element 520. For example, the resistance of the resistance element 520 to which a current is applied under control of the processor 460 may be changed as the temperature changes. The processor 460 may estimate the remaining amount of the aerosol generating material stored in the cartridge 20 based on the resistance change amount due to a change in the temperature of the resistance element 520. A specific method of estimating the remaining amount of the aerosol generating material based on the resistance change amount of the resistance element 520 will be described below with reference to FIGS. 7A through 9B.

The processor 460 may control a change in the temperature of the resistance element 520 to be in a temperature range in which an aerosol is not generated from the aerosol generating material in contact with the resistance element 520. The processor 460 may independently control the resistance element 520 to estimate the remaining amount of the aerosol generating material and the heater 420 to generate an aerosol. For example, the processor 460 may apply a current, having an intensity less than the current applied to the heater 420, to the resistance element 520, thereby controlling the resistance element 520 so that the temperature of the resistance element 520 changes to a temperature less than an evaporation point of the aerosol generating material. The processor 460 may apply a current, having an intensity greater than the current applied to the resistance element 520, to the heater 420, thereby controlling the heater 420 so that the heater 420 heats to a temperature higher than the evaporation point of the aerosol generating material.

The aerosol generating device 400 may further include a feedback line connected to the contact element 510 so as to measure the resistance change amount of the resistance element 520. A signal corresponding to the resistance change amount of the resistance element 520 may be transmitted to the processor 460 through the feedback line. For example, the signal may be transmitted to the processor 460 from the resistance element 520 through the feedback line so that the processor 460 may measure the magnitude of a current flowing through the resistance element 520 or the magnitude of a voltage applied to the resistance element 520. The processor 460 may measure the resistance change amount of the resistance element 520 through conversion or calculation of a signal corresponding to the change in resistance of the resistance element 520.

In an embodiment, the processor 460 may perform pulse width modulation (PWM) control so as to measure the resistance change amount of the resistance element 520. The processor 460 may apply a current caused by PWM control to the resistance element 520. A signal corresponding to the resistance change amount of the resistance element 520, to which the current caused by PWM control is applied, may be transmitted to the processor 460 through the feedback line. A signal corresponding to the resistance change amount of the resistance element 520 is an analog signal, and conversion into a digital signal may be required to analyze the analog signal. Thus, the processor 460 may convert the transmitted analog signal into a digital signal through an analog-digital converter (ADC) and may measure the resistance change amount of the resistance element 520 based on the digital signal.

In another embodiment, the processor 460 may apply a constant current to the resistance element 520 and may measure a voltage between a line for transmitting the constant current to the resistance element 520 and the feedback line. Because the processor 460 may determine the magnitude of the current and the magnitude of the voltage of the resistance element 520 due to the applied constant current, the processor 460 may measure the resistance change amount of the resistance element 520 through a calculation based on Ohm's law.

In another embodiment, the processor 460 may apply a constant voltage to the resistance element 520, and a current flowing through the resistance element 520 may be transmitted to the processor 460 through the feedback line so that the processor 460 may measure the magnitude of the current. Because the processor 460 may determine the magnitude of the voltage and the magnitude of the current flowing through the resistance element 520 due to the applied constant voltage, the resistance change amount of the resistance element 520 may be measured through a calculation based on Ohm's law.

FIG. 6 illustrates an example of the arrangement of a resistance element and a contact element.

The resistance element 520 may be arranged to pass through the housing 530 in the thickness direction of the housing 530. In detail, the resistance element 520 may be arranged to pass through an outer side surface and an inner side surface of the housing 530. The resistance element 520 may pass through the housing 530 in the thickness direction of the housing 530 so that one side surface of the resistance element 520 may be in contact with the aerosol generating material stored in the cartridge 20. In addition, another side surface of the resistance element 520, opposite to one side surface in contact with the aerosol generating material, may be in contact with the main body 10 in which the cartridge 20 is accommodated.

The contact element 510 may be located at a side of an accommodation space of the main body 10 and may be in contact with the resistance element 520 included in the cartridge 20 accommodated in the main body 10. The contact element 510 may be arranged at a position of the accommodation space of the main body 10 corresponding to the position of the resistance element 520 at the cartridge 20 so as to be in contact with the resistance element 520. The number of contact elements 510 in the main body 10 may correspond to the number of resistance elements 520. Contact elements 510 may be respectively in contact with resistance elements 520 and may be electrically connected thereto, and one contact element 510 may be in contact with a plurality of resistance elements 510 and may be electrically connected thereto.

The arrangement of the resistance element 520 and the contact element 510 shown in FIG. 6 is just an example and is not limited thereto. The numbers of resistance elements 520 and contact elements 510 and positions of the resistance element 520 and the contact element 510 may be variously set.

FIGS. 7A-C illustrate an example of a cartridge including one resistance element.

FIGS. 7A-C illustrate the cartridge 20 in which different amounts of aerosol generating materials are stored, respectively. FIG. 7A illustrates a case where an aerosol generating material is not in contact with the resistance element 520, FIG. 7B illustrates a case where an aerosol generating material is in contact with the resistance element 520, and FIG. 7C illustrates a case where a larger amount of aerosol generating material than in FIG. 7B is in contact with the resistance element 520.

In an embodiment, the processor 460 (refer to FIG. 5) may determine whether the aerosol generating material is in contact with the resistance element 520. Thus, the processor 460 may measure the remaining amount of the aerosol generating material. The processor 460 may compare a first threshold value with the resistance change amount, thereby determining whether the aerosol generating material is in contact with the resistance element 520. The first threshold value corresponds to a threshold value of the resistance change amount for determining whether the aerosol generating material is in contact with the resistance element 520, and a second threshold value to be described below with reference to FIGS. 8A-C corresponds to a threshold value for determining the level of the aerosol generating material.

The first threshold value may be set to a value between a resistance change amount measured when the aerosol generating material is in contact with the resistance element 520 and a resistance change amount measured when the aerosol generating material is not in contact with the resistance element 520. The first threshold value may be set considering, for example, a specific resistance of the resistance element 520, a resistance temperature coefficient of the resistance element 520, a material of the resistance element 520, the magnitude of the current applied to the resistance element 520, and the capacity of the cartridge 20.

When the resistance change amount of the resistance element 520 is less than the first threshold value, the processor 460 may determine that the aerosol generating material is in contact with the resistance element 520. In addition, when the resistance change amount of the resistance element 520 is greater than or equal to the first threshold value, the processor 460 may determine that the aerosol generating material is not in contact with the resistance element 520.

Because the resistance element 520 is arranged to be in contact with the aerosol generating material stored in the cartridge 20, even when a current having the same magnitude is applied to the resistance element 520, the resistance element 520 may have different amounts of temperature change depending on whether the aerosol generating material is in contact with the resistance element 520. When the aerosol generating material is not in contact with the resistance element 520, as shown in FIG. 7A, when a current is applied to the resistance element 520, only the resistance element 520 may heat. On the other hand, when the aerosol generating material is in contact with the resistance element 520, as shown in FIG. 7B and FIG. 7C, when a current is applied to the resistance element 520 such that the resistance element 520 heat, the aerosol generating material may be affected such that the aerosol generating material is also heated. With reference to the case where the aerosol generating material is in contact with the resistance element 520, the mass of an object to be heated is larger, and the heat capacity increases as the mass of the object to be heated increases. Thus, when a constant current is applied to the resistance element 520, the temperature change of the resistance element 520 is small in the case where the aerosol generating material is in contact with the resistance element 520 compared to when the aerosol generating material is not in contact with the resistance element 520.

With reference to FIG. 7A, when a current is applied to the resistance element 520, only the resistance element 520 is heated. Thus, the temperature change of the resistance element 520 and the resistance change amount thereof are larger than in the case of FIG. 7B and FIG. 7C. With reference to FIG. 7A, the resistance change amount of the resistance element 520 will be measured to be greater than or equal to the first threshold value. Thus, the processor 460 may determine that the aerosol generating material is not in contact with the resistance element 520. In this case, the processor 460 may determine that the level of the aerosol generating material is less than the height of the resistance element 520 arranged in the cartridge 20. When it is determined that the level of the aerosol generating material is less than the height of the resistance element 520, the processor 460 may determine that the remaining amount of the aerosol generating material is insufficient and may output a signal indicating the lack of the remaining amount.

With reference to FIG. 7B and FIG. 7C, when a current is applied to the resistance element 520, not only the resistance element 520 but also the aerosol generating material is heated, such that the temperature change of the resistance element 520 and a resistance change amount thereof is smaller than in the case of FIG. 7A. With reference to FIG. 7B and FIG. 7C, the resistance change amount of the resistance element 520 will be measured to be less than the first threshold value. Thus, the processor 460 may determine that the aerosol generating material is in contact with the resistance element 520. The processor 460 may determine that the level of the aerosol generating material is greater than or equal to the height of the resistance element 520 arranged in the cartridge 20.

In another embodiment, the processor 460 may estimate that the amount of the aerosol generating material in contact with the resistance element 520 increases as the resistance change amount of the resistance element 520 decreases. In addition, the processor 460 may estimate that the amount of the aerosol generating material in contact with the resistance element 520 decreases as the resistance change amount of the resistance element 520 increases. The processor 460 may estimate the remaining amount of the aerosol generating material according to the amount of the aerosol generating material in contact with the resistance element 520.

Referring to FIG. 7B and FIG. 7C, although the aerosol generating material is in contact with the resistance element 520 in both cases, the amounts of the contacting aerosol generating material are different. Because the heat capacity increases as the mass of the object to be heated increases, the temperature change of the resistance element 520 is smaller and the resistance change amount due to the temperature change is also smaller as the amount of the aerosol generating material in contact with the resistance element 520 increases when a constant current is applied to the resistance element 520.

With reference to FIG. 7C, because the amount of the aerosol generating material in contact with the resistance element 520 is greater than in the case of FIG. 7B, the resistance change amount of the resistance element 520 due to a constantly applied current is smaller. The processor 460 may estimate that the amount of the aerosol generating material in contact with the resistance element 520 increases as the resistance change amount decreases, thereby estimating the remaining amount of the aerosol generating material. Contrary to this, the processor 460 may estimate that the amount of the aerosol generating material in contact with the resistance element 520 decreases as the resistance change amount increases. When the value is greater than or equal to the first threshold value, the processor 460 may estimate that the aerosol generating material is not in contact with the resistance element 520.

FIGS. 8A-C illustrates an example of a cartridge including a plurality of resistance elements.

FIGS. 8A-C illustrate the cartridge 20 in which different amounts of aerosol generating materials are stored, respectively. FIG. 8A illustrates a case where an aerosol generating material is not in contact with any of the resistance elements

520*a*, 520*b*, 520*c*, and 520*d*, FIG. 8B illustrates a case where an aerosol generating material is in contact with only two resistance elements 520*b* and 520*d*, and FIG. 8C illustrates a case where the aerosol generating material is in contact with all resistance elements 520*a*, 520*b*, 520*c*, and 520*d*.

In the example illustrated in FIGS. 8A-C, the processor 460 may estimate the remaining amount of the aerosol generating material by using two methods. First, as described above with reference to FIGS. 7A-C, the processor 460 may compare the resistance change amount of the resistance element 520 with the first threshold value, thereby determining whether the aerosol generating material is in contact with the resistance element 520.

With reference to FIG. 8A, the resistance change amounts of all of the resistance elements 520*a*, 520*b*, 520*c*, and 520*d* is measured to be greater than or equal to the first threshold value. Thus, the processor 460 may determine that an aerosol generating material is not in contact with any of the resistance elements 520*a*, 520*b*, 520*c*, and 520*d*. In this case, the processor 460 may determine that the level of the aerosol generating material is less than the height of the resistance elements 520*a* and 520*d* at the lower end.

With reference to FIG. 8B, the resistance change amount of resistance elements 520*b* and 520*d* at the lower end is measured to be less than the first threshold value, and the resistance change amount of the resistance elements 520*a* and 520*c* at the upper end is measured to be greater than or equal to the first threshold value. Thus, the processor 460 may determine that an aerosol generating material is in contact with only the resistance elements 520*b* and 520*d* at the lower end and may determine that the level of the aerosol generating material is between the heights of the resistance elements 520*b* and 520*d* at the lower end and the resistance elements 520*a* and 520*c* at the upper end.

With reference to FIG. 8C, the resistance change amount of all of the resistance elements 520*a*, 520*b*, 520*c*, and 520*d* is measured to be less than the first threshold value. Thus, the processor 460 may determine that the aerosol generating material is in contact with all of the resistance elements 520*a*, 520*b*, 520*c*, and 520*d*. In this case, the processor 460 may determine that the level of the aerosol generating material is greater than or equal to a height of the resistance elements 520*a* and 520*c* at the upper end.

As a second method of measuring the remaining amount of the aerosol generating material, the processor 460 may individually measure the resistance change amount of each of the resistance elements (e.g., resistance elements 520*a*, 520*b*, 520*c*, and 520*d*) and may estimate the remaining amount of the aerosol generating material based on a difference between the individually-measured resistance change amounts. A signal may be individually applied to the processor 460 from each resistance element, so that the processor 460 may individually measure the resistance change amount. The processor 460 may individually measure the resistance change amount, thereby more precisely estimating the remaining amount of the aerosol generating material.

Referring to FIG. 8B, because the resistance change amount of the resistance element 520*b*, with which the aerosol generating material is in contact, is small, and the resistance change amount of the resistance element 520*a*, with which the aerosol generating material is not in contact, is large, a difference in the resistance change amount between the resistance element 520*b* with which the aerosol generating material is in contact and the resistance element 520*b* with which the aerosol generating material is not in contact is measured to be greater than when two resistance elements 520*a* and 520*b* are both in contact with the aerosol generating material or are both not in contact with the aerosol generating material. Thus, the processor 460 may determine whether only one of two resistance elements 520*a* and 520*b* is in contact with the aerosol generating material or both resistance elements 520*a* and 520*b* are in contact with or not in contact with the aerosol generating material, based on the difference in the resistance change amount.

The processor 460 may compare a second threshold value with the difference in the resistance change amount between any two resistance elements (e.g., resistance elements 520*a* and 520*b*), thereby determining the level of the aerosol generating material in the cartridge 20. The second threshold value corresponds to a threshold value in the resistance change amount for determining whether the level of the aerosol generating material is between any two resistance elements. The second threshold value may be set to be less than the difference in the resistance change amount between any two resistance elements measured when the level of the aerosol generating material is between the two resistance elements. The second threshold value may be set considering, for example, a specific resistance of the resistance element, a resistance temperature coefficient of the resistance element, a material of the resistance element, the magnitude of the current applied to the resistance element, and the capacity of the cartridge 20.

When the difference in the resistance change amount between any two resistance elements (e.g., resistance elements 520*a* and 520*b*) is greater than or equal to the second threshold value, the processor 460 may determine that the level of the aerosol generating material is between the two resistance elements. With reference to FIG. 8A and FIG. 8C, because the difference in the resistance change amount between the resistance elements 520*a*, 520*b*, 520*c*, and 520*d* is measured to be less than the second threshold value, the processor 460 may determine that the level of the aerosol generating material is lower or higher than the resistance elements 520*a*, 520*b*, 520*c*, and 520*d*.

On the other hand, with reference to FIG. 8B, the difference in the resistance change amount between the resistance elements 520*a* and 520*c* at the upper end and the resistance elements 520*b* and 520*d* at the lower end is measured to be greater than or equal to the second threshold value. Thus, the processor 460 may determine that the level of the aerosol generating material is between the resistance elements 520*a* and 520*c* at the upper end and the resistance elements 520*b* and 520*d* at the lower end.

FIGS. 9A-B illustrate an example in which a cartridge having a plurality of resistance elements is inclined.

FIGS. 9A-B illustrate the cartridge 20 in which different amounts of aerosol generating materials are stored, respectively.

FIG. 9A illustrates a case where only the resistance element 520*d* at the right lower-end is in contact with the aerosol generating material, and FIG. 9B illustrates a case where only the resistance element 520*a* at the left upper-end is not in contact with the aerosol generating material.

As shown in FIGS. 9A-B, when the resistance elements 520*c* and 520*d* at the right side and the resistance elements 520*a* and 520*b* at the left side are arranged symmetrical to each other, when the resistance change amounts of both the resistance elements 520*a* and 520*c* or the resistance elements 520*b* and 520*d* that face each other are different from each other, the processor 460 may determine that the cartridge 20 is inclined, and may determine the level of the aerosol generating material in a state in which the cartridge 20 is inclined. The processor 460 may measure the remaining amount of the aerosol generating material based on the level of the aerosol generating material.

As described above with reference to FIGS. 7A-C, the processor 460 may compare the first threshold value with the resistance change amount of the resistance element 520, thereby determining whether the aerosol generating material is in contact with the resistance element 520.

With reference to FIG. 9A, only the resistance change amount of the resistance element 520*d* at the right lower-end is measured to be less than the first threshold value, and the processor 460 may determine that only the resistance element 520*d* at the right lower-end is in contact with the aerosol generating material. Thus, the processor 460 may determine that the cartridge 20 is inclined to the right, and the processor may determine that the level of the aerosol generating material is between the resistance element 520*d* at the right lower-end and the resistance element 520*c* at the right upper-end and is at a lower position than the resistance elements 520*a* and 520*b* at the left side.

With reference to FIG. 9B, only the resistance change amount of the resistance element 520*a* at the left upper-end is measured to be greater than or equal to the first threshold value, and the processor 460 may determine that the aerosol generating material is not in contact with the resistance element 520*a* at the left upper-end. Thus, the processor 460 may determine that the cartridge 20 is inclined to the right and may determine that the level of the aerosol generating material is between the resistance element 520*a* at the left upper-end and the resistance element 520*b* at the left upper-end and is at a higher position than the resistance elements 520*c* and 520*d* at the right side.

As described above with respect to FIGS. 8A-C, the processor 460 may compare the second threshold value with the difference in the resistance change amounts between the resistance elements 520*a*, 520*b*, 520*c*, and 520*d*, thereby determining the level of the aerosol generating material in the cartridge 20.

With reference to FIG. 9A, a difference in the resistance change amount between the resistance element 520*d* at the right lower-end and the other resistance elements 520*a*, 520*b*, and 520*c* is measured to be greater than or equal to the second threshold value, and a difference in the resistance change amount between the other resistance elements 520*a*, 520*b*, and 520*c* is measured to be less than the second threshold value. Thus, the processor 460 may determine that the cartridge 20 is inclined to the right and the level of the aerosol generating material is between the resistance element 520*d* at the right lower-end and the other resistance elements 520*a*, 520*b*, and 520*c*.

With reference to FIG. 9B, a difference in the resistance change amount between the resistance element 520*a* at the left upper-end and the other resistance elements 520*b*, 520*c*, and 520*d* is measured to be greater than or equal to the second threshold value, and a difference in the resistance change amount between the other resistance elements 520*b*, 520*c*, and 520*d* is measured to be less than the second threshold value. Thus, the processor 460 may determine that the cartridge 20 is inclined to the right and the level of the aerosol generating material is between the lresistance element 520*a* at the left upper-end and the other resistance elements 520*b*, 520*c*, and 520*d*.

FIG. 10 illustrates another example of a cartridge having a plurality of resistance elements.

Referring to FIG. 10, unlike the embodiments shown in FIGS. 6 through 9, six resistance elements 520 are arranged on each of the front and rear surfaces of the cartridge 20. According to embodiments, the position of the resistance elements 520 and the number of resistance elements 520 may be variously set and may be arranged on the bottom surface of the cartridge 20, for example. The arrangement of the resistance element is not limited to the examples of FIGS. 6 through 10, and various modifications and other equivalent embodiments may be made.

FIG. 11 is a flowchart illustrating an example of a method of operating the aerosol generating device shown in FIG. 5.

Referring to FIG. 11, an example of the method of operating the aerosol generating device 400 includes operations to be performed in a time series by the aerosol generating device 400 shown in FIG. 5. It is to be understood that descriptions of the aerosol generating device 400 provided above with reference to FIGS. 1 through 10 may also applied to the method of operating the aerosol generating device 400 of FIG. 11.

In operation 1100, the aerosol generating device 400 may apply a current to at least one resistance element 520 that passes through the housing 530 in the thickness direction of the housing 530 that forms an accommodation space of the aerosol generating material.

One side surface of the resistance element 520 may be in contact with the aerosol generating material stored in the cartridge 20, and the other side surface of the resistance element 520 may be in contact with the main body 10 in which the cartridge 20 is accommodated.

In an embodiment, the aerosol generating device 400 may apply a current to the resistance element 520 so that the temperature of the resistance element 520 changes to a temperature less than an evaporation point of the aerosol generating material.

In operation 1120, the aerosol generating device 400 may measure the resistance change amount corresponding to the temperature change of at least one resistance element 520 due to the applied current.

In an embodiment, the aerosol generating device 400 may individually measure the resistance change amount generated from each of at least one resistance element 520.

In another embodiment, the aerosol generating device 400 may apply a current caused by PWM control to the resistance element 520, may convert a signal corresponding to the resistance change amount into a digital signal through an ADC and may measure the resistance change amount based on the digital signal.

In operation 1130, the aerosol generating device 400 may estimate the remaining amount of the aerosol generating material stored in the accommodation space based on the resistance change amount.

In an embodiment, when the resistance change amount is less than the first threshold value, the aerosol generating device 400 may determine that the aerosol generating material is in contact with the resistance element 520, and when the resistance change amount is greater than or equal to the first threshold value, the aerosol generating device 400 may determine that the aerosol generating material is not in contact with the resistance element 520 and may estimate the remaining amount of the aerosol generating material depending on whether the aerosol generating material is in contact with the resistance element 520.

In another embodiment, the aerosol generating device 400 may estimate that the amount of the aerosol generating material contacting the resistance element 520 increases as the resistance change amount decreases and may estimate that the amount of the aerosol generating material contacting the resistance element 520 decreases as the resistance change amount increases.

In another embodiment, the aerosol generating device 400 may estimate the remaining amount based on a difference between individually-measured resistance change amounts. For example, when the difference in the resistance change amount between any two resistance elements 520 is greater than or equal to the second threshold value, the aerosol generating device 400 may determine that the level of the aerosol generating material in the cartridge 20 is between the two resistance elements 520.

FIG. 12 is a block diagram illustrating an example of the configuration of a cartridge.

Referring to FIG. 12, a cartridge 20 may include a liquid storage 21, a liquid delivery element 1210, a heater 420, and a resistance element 520. The liquid storage 21, the liquid delivery element 1210, the heater 420, and the resistance element 520 of FIG. 12 may correspond to the cartridge 20, the liquid storage 21, a liquid delivery element, the heater 420, and the resistance element 520 of the embodiment illustrated in FIG. 5.

Some components related to the present embodiment are shown in the cartridge 20 shown in FIG. 12. However, it will be understood by those skilled in the art that general-purpose components other than the components shown in FIG. 12 may be further included in the cartridge 20.

The liquid storage 21 may include a housing 530 (refer to FIG. 5) that forms the accommodation space of the aerosol generating material. The aerosol generating material may be stored in the accommodation space formed in the housing 530. The liquid delivery element 1210 may receive the aerosol generating material from the liquid storage 21. The heater 420 may heat the aerosol generating material delivered to the liquid delivery element 1210 at a temperature higher than the evaporation point of the aerosol generating material, thereby generating an aerosol.

The resistance element 520 may pass through the housing 530 in the thickness direction of the housing 530. For example, one side surface of the resistance element 520 may be in contact with the aerosol generating material stored in the liquid storage 21, and another side surface of the resistance element 520, opposite to the one side surface, may be in contact with the main body 10 (refer to FIG. 5) in which the cartridge 20 is accommodated. The temperature of the resistance element 520 may change to a temperature less than the evaporation point of the aerosol generating material due to the current applied from the main body 10.

The remaining amount of the aerosol generating material stored in the liquid storage 21 may be estimated based on the resistance change amount of the resistance element 520 due to the current applied to the resistance element 520 from the main body 10. In an embodiment, when the resistance change amount of the resistance element 520 is less than the first threshold value, it may be determined that the aerosol generating material is in contact with the resistance element 520, and when the resistance change amount of the resistance element 520 is greater than or equal to the first threshold value, it may be determined that the aerosol generating material is not in contact with the resistance element 520. The remaining amount of the aerosol generating material may be estimated depending on whether the aerosol generating material is in contact with the resistance element 520. The first threshold value with respect to the resistance change amount may be set considering a specific resistance of the resistance element 520, a resistance temperature coefficient of the resistance element 520, a material of the resistance element 520, the magnitude of the current applied to the resistance element 520, and the capacity of the cartridge 20.

The descriptions of the above-described embodiments are merely examples, and it will be understood by one of ordinary skill in the art that various changes and equivalents thereof may be made.

What is claimed is:

1. An aerosol generating device comprising:

a cartridge configured to store an aerosol generating material; and a main body configured to accommodate the cartridge, wherein the cartridge comprises:

a housing that includes an accommodation space that is configured to accommodate the aerosol generating material; and at least one resistance element that passes through the housing in a thickness direction of the housing, wherein the main body comprises at least one contact element that is configured to be electrically connected to the at least one resistance element in a case where the cartridge is accommodated in the main body, and wherein the aerosol generating device further comprises at least one processor configured to estimate a remaining amount of the aerosol generating material based on a resistance change amount of the at least one resistance element due to a current applied to the at least one resistance element through the at least one contact element.

2. The aerosol generating device of claim 1, wherein one side surface of the at least one resistance element is configured to be in contact with the aerosol generating material, and another side surface of the at least one resistance element, opposite to the one side surface, is in contact with the main body.

3. The aerosol generating device of claim 1, wherein the at least one processor is configured to:

based on determining that the resistance change amount is less than a first threshold value, determine that the aerosol generating material is in contact with the at least one resistance element, based on determining that the resistance change amount is greater than or equal to the first threshold value, determine that the aerosol generating material is not in contact with the at least one resistance element, and estimate the remaining amount depending on whether the aerosol generating material is determined to be in contact with the at least one resistance element.

4. The aerosol generating device of claim 1, wherein the at least one processor is configured to:

estimate that an amount of the aerosol generating material contacting the at least one resistance element increases based on detecting that the resistance change amount decreases, and estimate that the amount of the aerosol generating material contacting the at least one resistance element decreases based on detecting that the resistance change amount increases.

5. The aerosol generating device of claim 1, wherein the at least one resistance element is a plurality of resistance elements, and the at least one processor is configured to measure an individual resistance change amount of each of the plurality of resistance elements and estimate the remaining amount of the aerosol generating material based on a difference between the individual resistance change amount of a first resistance element from among the plurality of resistance elements and the individual resistance change amount of a second resistance element from among the plurality of resistance elements.

6. The aerosol generating device of claim 5, wherein the at least one processor is configured to determine that a level of the aerosol generating material in the cartridge is between the first resistance element and the second resistance element, based on the difference between the individual resistance change amount of the first resistance element and the individual resistance change amount of the second resistance element being greater than or equal to a second threshold value.

7. The aerosol generating device of claim 1, wherein the at least one processor is configured to estimate the remaining amount of the aerosol generating material based on the resistance change amount corresponding to a temperature change of the at least one resistance element due to the applied current.

8. The aerosol generating device of claim 7, wherein the at least one processor is configured to apply the current to the at least one resistance element such that a temperature of the at least one resistance element changes to a temperature less than an evaporation point of the aerosol generating material.

9. The aerosol generating device of claim 1, wherein the at least one processor is configured to apply the current to the at least one resistance element by pulse width modulation (PWM) control, convert a signal corresponding to the resistance change amount into a digital signal through an analog-to-digital converter (ADC), and measure the resistance change amount based on the digital signal.

10. A method of operating an aerosol generating device, the method comprising:

applying a current to at least one resistance element of the aerosol generating device, the at least one resistance element passing through a housing of the aerosol generating device in a thickness direction of the housing, the housing including an accommodation space for accommodating an aerosol generating material;

measuring a resistance change amount corresponding to a temperature change of the at least one resistance element due to the applied current; and estimating a remaining amount of the aerosol generating material stored in the accommodation space based on the resistance change amount.

11. The method of claim 10, wherein the estimating of the remaining amount comprises:

determining whether the aerosol generating material is in contact with the at least one resistance element based on whether the resistance change amount is less than a first threshold value or greater than or equal to the first threshold value; and estimating the remaining amount depending on whether the aerosol generating material is determined to be in contact with the at least one resistance element.

12. A cartridge used for an aerosol generating device, the cartridge comprising:

a liquid storage comprising a housing that includes an accommodation space, the housing configured to store an aerosol generating material in the accommodation space;

a liquid delivery element configured to receive the aerosol generating material from the liquid storage;

a heater configured to heat the aerosol generating material delivered to the liquid delivery element;

at least one resistance element that passes through the housing in a thickness direction of the housing; and at least one processor configured to estimate a remaining amount of the aerosol generating material based on a resistance change amount of the at least one resistance element due to a current applied to the at least one resistance element through the at least one contact element, wherein one side surface of the at least one resistance element is configured to be in contact with the aerosol generating material, and another side surface of the at least one resistance element, opposite to the one side surface, is configured to be in contact with a main body of the aerosol generating device, such that the at least one resistance element is electrically connected to at least one contact element of the main body.

13. The cartridge of claim 12, wherein the at least one resistance element is a plurality of resistance elements.

14. The cartridge of claim 13, wherein the plurality of resistance elements comprises a first resistance element and a second resistance element, the second resistance element located at a different height position in the housing than the first resistance element.

* * * * *